US010058981B2

(12) United States Patent
Ferreira et al.

(10) Patent No.: US 10,058,981 B2
(45) Date of Patent: Aug. 28, 2018

(54) HOLDING DEVICE FOR A SHEET AT A WORK STATION OF A CONVERTING MACHINE

(75) Inventors: Paulo Ferreira, Daillens (CH); Pascal Ramoni, Echallens (CH)

(73) Assignee: BOBST MEX SA (CH)

( * ) Notice: Subject to any disclaimer, the term of this patent is extended or adjusted under 35 U.S.C. 154(b) by 208 days.

(21) Appl. No.: 13/704,368

(22) PCT Filed: Jun. 21, 2011

(86) PCT No.: PCT/EP2011/003063
§ 371 (c)(1),
(2), (4) Date: Dec. 14, 2012

(87) PCT Pub. No.: WO2011/160816
PCT Pub. Date: Dec. 29, 2011

(65) Prior Publication Data

US 2013/0087960 A1 Apr. 11, 2013

(30) Foreign Application Priority Data

Jun. 23, 2010 (EP) ..... 10006503

(51) Int. Cl.
*B25B 11/00* (2006.01)
*B26D 7/18* (2006.01)
(Continued)

(52) U.S. Cl.
CPC ..... *B25B 11/005* (2013.01); *B26D 7/1836* (2013.01); *B26D 7/1863* (2013.01);
(Continued)

(58) Field of Classification Search
CPC . B65H 5/08; B65H 5/22; B65H 5/222; B65H 5/228; B65H 29/04; B65H 29/042;
(Continued)

(56) References Cited

U.S. PATENT DOCUMENTS 4,066,249 A * 1/1978 Huber et al. ..... 269/21
5,211,092 A * 5/1993 Blasi ..... 83/98
(Continued)

FOREIGN PATENT DOCUMENTS

EP 1 155 791 A2 11/2001
EP 1 524 221 A1 4/2005
(Continued)

OTHER PUBLICATIONS

International Search Report dated Oct. 5, 2011 issued in corresponding International patent application No. PCT/EP2011/003063.

*Primary Examiner* — David Bryant
*Assistant Examiner* — Nirvana Deonauth
(74) *Attorney, Agent, or Firm* — Ostrolenk Faber LLP

(57) ABSTRACT

A holding device for holding an element in sheet form 10 during its phase of insertion into a work station 300 of a converting machine 1. The holding device 310 includes a suction member 320 able to partially hold each sheet 10 by its rear portion during insertion of the sheet 10 into the work station 300. The holding device also includes a blower 330 able to flatten the rear portion of each sheet 10 against the suction member 320 during the phase of insertion.

14 Claims, 2 Drawing Sheets

(51) Int. Cl.
*B65H 29/04* (2006.01)
*B65H 29/68* (2006.01)

(52) U.S. Cl.
CPC ..... *B65H 29/044* (2013.01); *B65H 29/686* (2013.01); *B65H 2406/12* (2013.01); *B65H 2406/351* (2013.01); *B65H 2701/1313* (2013.01); *B65H 2701/176* (2013.01); *B65H 2701/1762* (2013.01); *B65H 2801/42* (2013.01)

(58) Field of Classification Search
CPC .... B65H 29/044; B65H 29/24; B65H 29/241; B65H 29/245; B65H 29/686; B65H 2801/42; B65H 2701/1313; B65H 2406/12; B65H 2406/351; B25B 11/005; B26D 7/1836; B26D 7/1863
USPC ..... 269/21; 270/52.16, 52.22, 52.29; 101/408, 419, 420; 412/10; 198/470.1, 198/678.1, 689.1; 271/204
See application file for complete search history.

(56) References Cited

U.S. PATENT DOCUMENTS 5,259,608 A * 11/1993 Pollich ..... B41F 23/0443 271/183
5,368,148 A * 11/1994 Orlandini ..... G07D 7/12 194/207
5,445,372 A * 8/1995 Blaser ..... B65H 29/041 271/204
5,557,387 A * 9/1996 Hatano ..... B65H 3/126 271/11
5,915,304 A * 6/1999 Stiel ..... B41F 23/0423 101/416.1
6,241,238 B1 * 6/2001 Aoki ..... B41F 21/08 271/183
6,272,989 B1 * 8/2001 Misono et al. ..... 101/474
6,629,692 B2 * 10/2003 Allner et al. ..... 271/98
6,745,685 B2 * 6/2004 Kinoshita et al. ..... 101/118
7,850,166 B2 * 12/2010 Ichimura ..... B65H 29/041 271/176
2012/0247352 A1 * 10/2012 Fornay ..... B41F 19/06 101/27
2013/0160663 A1 * 6/2013 De Gaillande ..... B41F 1/12 101/287
2013/0200563 A1 * 8/2013 Clevers ..... 271/7

FOREIGN PATENT DOCUMENTS

EP 1 593 468 A1 11/2005
EP 1 935 820 A2 6/2008

* cited by examiner

HOLDING DEVICE FOR A SHEET AT A WORK STATION OF A CONVERTING MACHINE

CROSS-REFERENCE TO RELATED APPLICATIONS

The present application is a 35 U.S.C. §§ 371 national phase conversion of PCT/EP2011/003063, filed Jun. 21, 2011, which claims priority of European Application No. 10006503.6, filed Jun. 23, 2010, the contents of which are incorporated by reference herein. The PCT International Application was published in the French language.

BACKGROUND OF THE INVENTION

The present invention relates to a device to hold sheet form elements when they are inserted one by one into a work station fitted to a converting machine.

The invention finds a particularly advantageous, but not exclusive, application in the field of manufacturing cardboard packages.

It is known practice to cut blanks in a succession of sheets by means of a converting machine commonly known as a cutting press. In this type of machine, each sheet is inserted successively into a cutting station inside which the actual cutting operation takes place, then into a stripping station where the waste generated by the previous step is removed.

Each sheet is inserted individually in a precut form into such a waste stripping station. Specifically, the blanks are cut but are still attached to one another by attachment points. The same applies to many sheet portions that are of no final use and that are therefore considered to be waste.

When a cut sheet decelerates in the stripping station, before stopping between the ejection tools, its rear portion naturally tends to catch up with its front portion that is held by the gripper bar. This phenomenon is particularly noticeable when the sheets are relatively light in weight and/or large in size.

However that may occur, its consequence is that the flatness of the sheet is substantially deformed. This increases by the same amount as the risk of offset relative to the tools. It is known that the ejection operation requires precision in the prior positioning of the sheet. The precision naturally is all the finer if the waste has small dimensions.

In order to remedy this problem, thought has been given to holding each cut sheet during its insertion into the stripping station by holding it partially by its rear portion. For this, systems have notably been developed that generate a local suction on one face of the sheet. We are thinking notably in this instance of a Bernoulli tablet placed crosswise at the entrance to the stripping station.

This type of arrangement however has the drawback of providing insufficient effectiveness with sheets having a low basis weight, notably with those of less than 400 g. Specifically, when the sheet is too light, its rear portion tends to float during the movement and thus be relatively distant from the Bernoulli tablet. The latter can then not correctly fulfil its suction function.

In the end, this makes the positioning of the sheet more than approximate and this therefore generates inaccuracy at the time of ejection of the waste. But the lack of effectiveness of the Bernoulli tablet also causes banging at the rear portion of the sheet. The result of this is that many attachment points tend to break which becomes problematic at the time of ejection of the waste and often forces the operator of the converting machine to lower the production rate.

SUMMARY OF THE INVENTION

Therefore, the technical problem to be solved by the subject of the present invention is to propose a holding device for holding an element in sheet form during its phase of insertion into a work station of a converting machine. The holding device comprises a suction member able to partially hold each sheet by its rear portion during the phase of insertion of said sheet into the work station, and the holding device would make it possible to avoid the problems of the prior art by providing notably a substantially improved effectiveness.

The solution to the technical problem, according to the present invention, is that the holding device also comprises a blower able to flatten the rear portion of each sheet against the suction member during the phase of insertion.

It is understood that, in the whole of this text, the word "sheet" applies very generally to any element in sheet form, such as for example a sheet of paper, solid board, corrugated board, plastic, etc.

The principle of the invention therefore consists in combining the action of a suction member with that of a blower. Schematically, the airstream generated by the blower presses on one face of the sheet, which makes it possible to flatten the other face against the suction member and therefore to ensure the full effectiveness of the latter.

The invention as thus defined has the advantage of effectively holding the sheets in the work station, irrespective of their basis weight and/or the format of the sheets. This makes it possible in the end to make the converting machine operate at a high production rate.

The present invention also relates to the features that will emerge during the following description and that are considered in isolation or in all their technically possible combinations.

This description, given as a not restrictive example, is designed to make it easier to understand what the invention consists in and how it can be embodied. The description is moreover given with reference to the appended drawings in which:

DESCRIPTION OF A PREFERRED EMBODIMENT

For reasons of clarity, the same elements have been indicated by identical reference numbers. Only the elements that are essential to the understanding of the invention have been shown, and this has been done not to scale and in a schematic manner.

Figure 1:
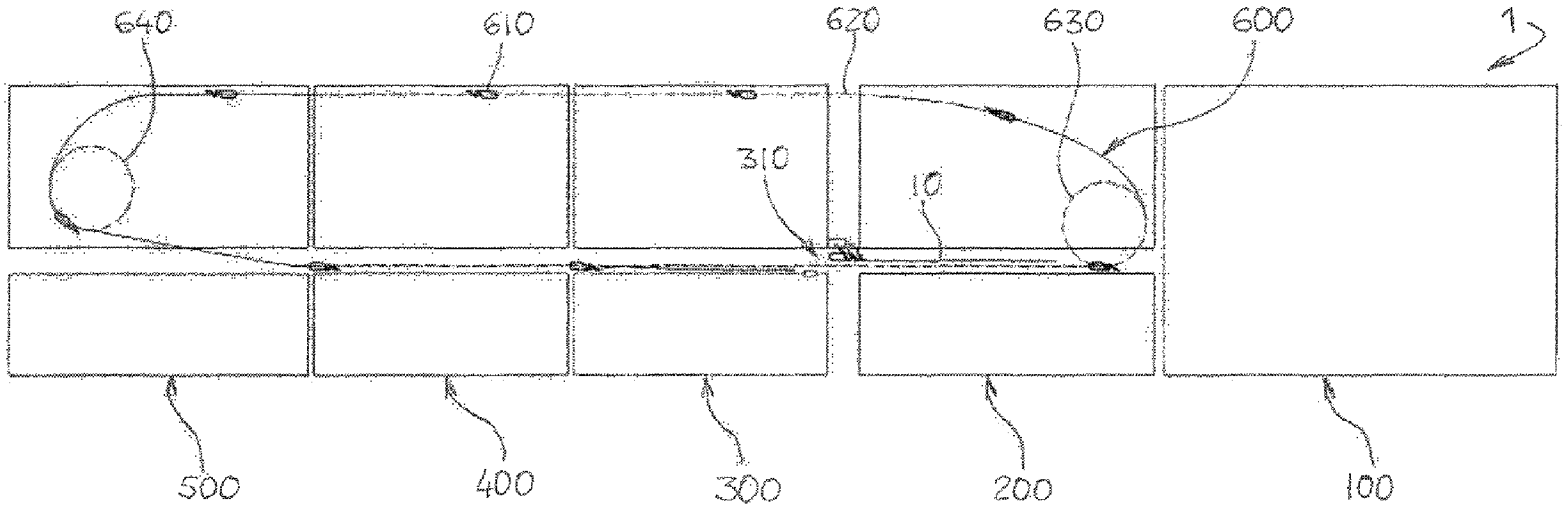
FIG. 1 illustrates a converting machine into which a waste stripping station is incorporated that is fitted with a holding device according to the invention.

FIG. 1 represents a converting machine 1 making it possible to cut blanks in a succession of cardboard sheets 10.

These blanks are intended to be subsequently folded and bonded to form packaging boxes.

In this particular embodiment, chosen only as an example, the converting machine 1 conventionally comprises several work stations 100, 200, 300, 400, and 500 that are juxtaposed but interdependent one by one in order to form a unitary assembly. There is therefore an infeed station 100, a cutting station 200, a waste stripping station 300, a delivery station 400 with separation of the blanks, and an evacuation station 500 for removing the residual waste. Also visible is a conveyor 600 that individually moves each sheet 10 from the outlet of the infeed station 100 to the discharge station 500.

Figure 2:
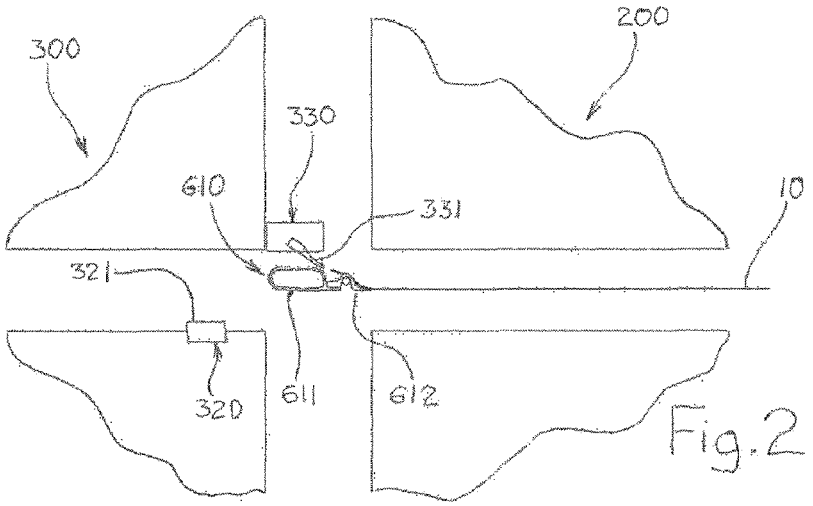
FIG. 2 shows in detail the entrance of the waste stripping station at the moment when a sheet is ready to be inserted therein.
Figure 3:
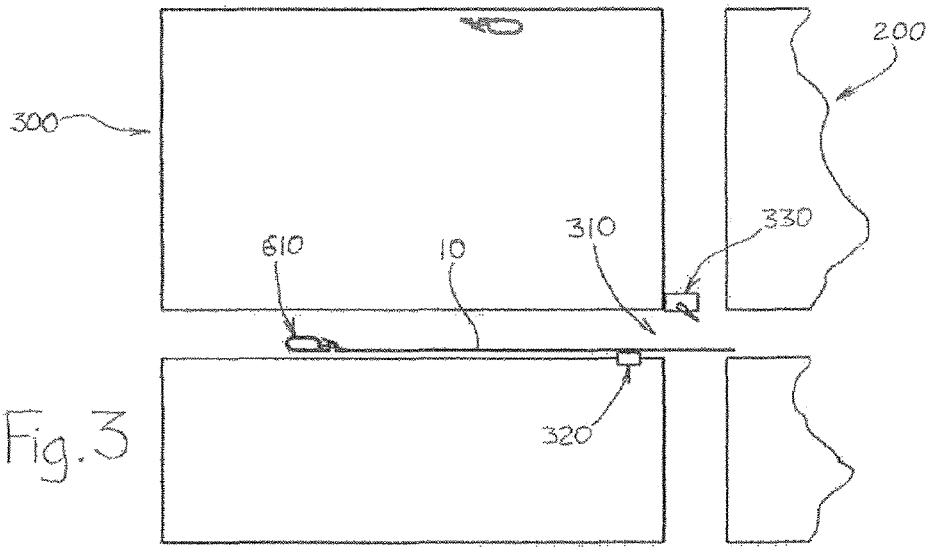
FIG. 3 is a view that is substantially similar to FIG. 2 but with the sheet at the end of the phase of insertion in the waste stripping station.

It should be noted that in all of the FIGS. 1 to 3, the various work stations 100, 200, 300, 400, 500 have been shown in an extremely schematic manner. Each of them specifically takes the form of two rectangles symbolizing respectively its top portion and its bottom portion that are positioned on either side of the plane of movement of the sheets 10.

In a conventional manner, the infeed station 100 mainly comprises a feeder and a feed table, and it is fed with cardboard sheets 10 from a stack stored on a pallet. The feeder is more particularly responsible for removing the sheets 10 one by one from the top of the stack and sending them successively to the feed table that is immediately adjacent. On the feed table, the sheets 10 are placed in an overlapping stream, that is to say placed one after the other so as to overlap partially. The whole of the overlapping stream is conveyed along a plate by means of a belt conveyor system in the direction of the cutting station 200. At the end of the overlapping stream, the leading sheet 10 is systematically positioned with precision by means of a registration system commonly called a register. Since such an infeed station 100 is perfectly well known from the prior art, it will not be described further here. It is also the reason for which these various components have not been shown in detail in the figures.

The cutting station 200 for its part takes the conventional form of a platen press which, in this exemplary embodiment, uses a fixed upper platen on the bottom face of which a cutting tool is secured and a moveable lower platen on the top face of which the creasing counterparts are attached.

The work station situated just after the cutting station 200 is the stripping station 300. The function of the latter is to remove the waste that is directly produced when the sheets 10 are cut. We are notably thinking here of central waste areas and of rear and side strips. However that may be, this operation is carried out here conventionally by virtue of the interaction of three elements, namely an upper stripping tool, a central stripping board and a lower stripping tool.

Downstream of the stripping station 300, there is the delivery station 400 the main function of which consists in breaking the attachment points between the blanks by means of a male upper tool and a female lower tool. The objective is twofold, namely to separate the blanks from one another, and form stacks of blanks able to be worked on subsequently by folder-gluers.

The process of treating the sheets 10 in the converting machine 1 ends in the evacuation station 500 where the residual waste is removed. The latter is automatically released and then discharged from the evacuation station 500 by a conveyor.

The converting machine 1 has a conveyor 600 to make it possible to individually move each sheet 10 from the outlet of the infeed station 100 to the evacuation station 500.

In a conventional manner, the conveyor 600 uses a series of gripper bars 610 that are mounted so as to be moveable in translation crosswise by means of two chain systems 620 placed laterally on each side of the converting machine 1. Each chain system 620 travels round a loop which allows the gripper bars 610 to follow a trajectory passing successively by the cutting station 200, the stripping station 300, the delivery station 400 and the evacuation station 500.

In practice, each gripper bar 610 travels on an outward path in a substantially horizontal plane of passage between a drive wheel 630 and an idler wheel 640, and then a return path in the top portion of the converting machine 1. Once returned to the drive wheel 630, each gripper bar 610 is then able to grip a new sheet 10.

As can be seen more clearly in FIG. 2, each gripper bar 610 comprises a crossbar 611 on which is mounted a plurality of grippers 612 that are able to grip the front edge of the same sheet 10 simultaneously. Each gripper bar 610 is coupled to two chain systems 620 by means of the two ends of its crossbar 611.

FIGS. 1 to 3 show that the stripping station 300 is moreover furnished with a holding device 310 for holding each sheet 10 during its phase of insertion. This holding device 310 comprises a suction member 320 that is responsible for partially holding each sheet 10 by its rear portion during its phase of insertion into the stripping station 300. In practice, the suction member 320 holds the rear portion of the sheet 10 without immobilizing it, while allowing it to slide progressively as it moves according to FIG. 3.

In the present case, the suction member 320 takes the form of a Bernoulli tablet 321, that is a device provided with several suction holes at each of which a vacuum is created individually by Venturi effect. Since this type of member is known per se, it will not be described further here either structurally or functionally. The Bernoulli tablet 321 is installed crosswise at the entrance of the stripping station 300, and at the bottom portion of the station in order to be positioned under the plane of movement of the sheets 10, and thus to be able to act on the bottom face of the latter.

According to the present invention, the holding device 310 is also provided with a blower 330 aimed and operable to flatten the rear portion of each sheet 10 against the suction member 320 during the phase of insertion.

The blower 330 generates an airstream on each sheet 10 being inserted into the stripping station 300, on the face of the sheet 10 that is away from the suction member 320. Initially, the airstream tends to push the sheet 10 in the direction toward the suction member 320, until it brings a portion of the sheet into effective contact with the suction member 320. Secondly, the airstream exerts a pressure on the rear portion of the sheet 10 which will naturally tend to flatten it against the suction member 320.

According to a particular feature of the invention, the blower 330 generates an airstream on a portion of the sheet 10 that is situated upstream of the suction member 320 relative to the direction of movement of the sheet 10 into the stripping station 300. It is understood here that the airstream is able to apply pressure to any portion of sheet 10 that has not yet passed the suction member 320, including the portion of the sheet 10 that is placed directly in line with said suction member 320.

According to another particular feature of the invention, the blower 330 is able to generate an airstream as close as possible to the plane of movement of the sheets 10 into the stripping station 300. Such proximity makes it possible to maximize the pressure applied by the airstream for a given blowing power, or to minimize the dimensions of the blower for an equivalent result.

In a particularly advantageous manner, the blowing means 330 generates an airstream on substantially the whole width of each sheet 10 being inserted into the stripping station 300. This feature is the result of the fact that usually, the suction member 320 is designed such that it can also act on the whole width of the sheets 10.

According to another advantageous feature, the blower 330 is able to generate a substantially flat airstream in a direction that is coplanar with the direction of movement of the sheets 10 into the stripping station 300. The fact that the airstream is substantially flat means that it has to some extent the shape of an air curtain, that is a substantially laminar stream the section of which has a width much greater than its height. The fact that the airstream is blown in a direction coplanar with the direction of movement of the sheets 10 means that the plane in which the airstream is propagated intersects the plane of movement of the sheets 10 in a straight line that is substantially orthogonal to the direction of movement of the sheets 10 into the stripping station 300.

According to another particular feature of the invention, the blower 330 is able to generate an airstream in a direction that is inclined relative to the normal to the plane of movement of the sheets 10 and that is directed in a direction substantially contrary to the direction of movement of said sheets 10 into the stripping station 300. The main objective here would be to ensure a perfect spreading out of the sheet 10, by virtue of the fact that the pressure applied by the airstream is applied in a direction substantially contrary to the direction of movement of the sheet 10.

The foregoing being so, such an arrangement is also advantageous when the sheet 10 has not yet arrived in line with the blower 330 but is still in the cutting station 200 placed directly upstream. Specifically, in such a situation, the airstream originating from the blower 330 will be propagated at least partially under the sheet 10. By the Venturi effect, this will create a depression that will tend to pull the sheet 10 downward, thereby making it easier to detach blanks from the platen press.

Preferably, the blower 330 generates an airstream with an angle of incidence of 30 to 50° relative to the plane of movement of the sheets 10 into the stripping station 300.

According to a currently preferred embodiment of the invention, because it is perfectly suited to the converting machines 1 operating at very high production rates, the blower 330 operates in this instance continuously. This being so, it is naturally possible to provide a more or less discontinuous operating mode of the blower 330.

In the same manner, the blower 330 operates in this instance at constant power, but it is conceivable to cause the blower 330 to operate with a variable power level.

In this preferred embodiment, the blower 330 may be disengaged. This feature makes the converting machine 1 versatile in its entirety. Specifically it offers the possibility of making the holding device 310 operate without the blower 330. This constitutes a solution that is particularly suitable for low production rates and/or for the working of relatively stiff sheets.

As can be seen more clearly in FIGS. 2 and 3, the blower 330 comprises at least one nozzle 331 furnished with a slot-shaped outlet orifice which is oriented parallel to the plane of movement of the sheets 10 into the stripping station 300. In practice, two situations will mainly occur. Either the blower 330 uses only one nozzle 331 acting over substantially the whole width of the sheet 10, or places a plurality of nozzles 331 that are juxtaposed in order to substantially cover the whole width of the sheet 10.

In the exemplary embodiment of FIGS. 1 to 3, since each sheet 10 is inserted into the stripping station 300 by means of a gripper bar 610 supporting a plurality of grippers 612, the blower 330 comprise several nozzles 331 positioned crosswise at locations offset relative to the respective trajectories of movement of the various grippers 612 of the gripper bar 610. This arrangement prevents directing the airstream directly against the grippers 612 and therefore avoids creating unnecessary turbulence capable of diminishing the effectiveness of the blower 330.

Naturally, the invention also relates to any work station 200, 300, 400 designed to be fitted to a converting machine 1, and having a holding device 310 as described above. This includes a waste stripping station 300 as in the particular embodiment chosen to illustrate the invention, but also a cutting station 200 or a delivery station 400 with separation of the blanks.

But in a yet more general manner, the invention also relates to any converting machine 1 fitted with, at least one such work station 200, 300, 400.

In the exemplary embodiment, the holding device 310 is fully incorporated into the injection station 300, that is including the blower 330 which thus forms an integral part of the work station. Nonetheless, when the converting machine 1 comprises a first work station 300 fitted with a holding device 310 as described above, and a second work station 200 placed directly upstream of the first work station 300, it is conceivable to install the suction member 320 in the first work station 300 and to install the blower 330 in the second work station 200.

The invention claimed is:

1. A converting machine, comprising: a work station having a holding device that holds an element during insertion of the element into the work station of the converting machine by a moving conveyor that has engaged a leading portion of the element, the holding device comprises: a suction member fixed in position relative to the conveyor, configured and operable to, in operation, apply a force to a first surface of the element to pull the element toward the suction member with a force sufficient only to partially hold the element such that the suction member is arranged to partially hold a rear trailing portion of the element during the insertion of the element into the work station, the applied force permitting the element to slide on the suction member as the element is moved by the conveyor relative to the suction member; and a blower having a nozzle positioned at an angle relative to a normal to plane movement of the element positioned to blow air toward a second surface of the element opposite the first surface, configured and operable to, in operation, blow air with sufficient force to flatten the rear trailing portion of the element against the suction member during the insertion, wherein the blower is located upstream of the suction member relative to the direction of movement of the element into the work station, and is configured and operable to generate an airstream on the second surface of the element as it is being inserted into the work station, and the second surface of the element is away from the suction member, wherein the blower is configured and operable and aimed to generate an airstream on a portion of the element that is upstream of the suction member relative to the direction of movement of the element into the work station, the portion of the element that is upstream being a portion that has not yet passed the suction member, and wherein the element is in sheet form.

2. The converting machine according to claim 1, wherein the blower is configured and operable and aimed to generate an airstream along a plane of movement of the element into the work station.

3. The converting machine according to claim 1, wherein the blower is configured and operable and aimed to generate an airstream on substantially a whole width of the element being inserted into the work station.

4. The converting machine according to claim 1, wherein the blower is configured and operable and aimed to generate a substantially flat airstream in a direction that is substantially coplanar with the direction of movement of the element into the work station.

5. The converting machine according to claim 1, wherein the blower is configured and operable to generate an airstream in a direction that is inclined relative to the normal to the plane of movement of the element and that is directed in a direction substantially contrary to a direction of movement of the element into the work station.

6. The converting machine according to claim 5, wherein the blower is configured and operable and aimed to generate an airstream with an angle of incidence of 30 to 500 relative to the plane of movement of the element into the work station.

7. The converting machine according to claim 1, wherein the blower operates continuously.

8. The converting machine according to claim 1, wherein the blower is configured to operate at constant power.

9. The converting machine according to claim 1, wherein the blower is able to be disengaged.

10. The converting machine according to claim 1, wherein the blower comprises at least one nozzle furnished with a slot-shaped outlet orifice and the slot is oriented parallel to a plane of movement of the element into the work station.

11. The converting machine according to claim 1, further comprising a gripper bar supporting a plurality of grippers which are configured and operable for gripping each sheet in turn and for inserting the sheet then being gripped into the work station; and the blower comprises several nozzles positioned transversely in an offset manner relative to respective trajectories of movement of the various grippers of the gripper bar.

12. The converting machine according to claim 1, wherein the work station is one of a plurality of work stations in the converting machine.

13. The converting machine according to claim 1, further comprising a second work station placed directly upstream of the work station with respect to movement of the element into the work station, wherein the suction member is at the work station, and the blower is at the second work station.

14. A converting machine comprising: a work station having a holding device that holds an element during insertion of the element into the work station of the converting machine by a moving conveyor that has engaged a leading portion of the element, the holding device comprises: a suction member fixed in position relative to the conveyor, configured and operable to, in operation, apply a force to a first surface of the element to pull the element toward the suction member with a force sufficient only to partially hold the element such that the suction member is arranged to partially hold a rear trailing portion of the element during the insertion of the element into the work station, the applied force permitting the element to slide on the suction member as the element is moved by the conveyor relative to the suction member; and a blower positioned to blow air toward a second surface of the element opposite the first surface, configured and operable to, in operation, blow air with sufficient force to flatten the rear trailing portion of the element against the suction member during the insertion, wherein the blower is configured and operable to generate an airstream on the second surface of the element as it is being inserted into the work station, and the second surface of the element is away from the suction member, wherein the airstream is inclined relative to the normal to plane of movement of the element and directed in a direction substantially contrary to direction of movement of the element, and wherein the blower is positioned upstream of the suction member relative to the direction of movement of the element into the work station, and is configured and operable and aimed to generate an airstream on a portion of the element that is upstream of the suction member relative to the direction of movement of the element into the work station, the portion of the element that is upstream being a portion that has not yet passed the suction member, and wherein the element is in sheet form.

* * * * *